US007325341B2

(12) United States Patent
Mouyal

(10) Patent No.: US 7,325,341 B2
(45) Date of Patent: Feb. 5, 2008

(54) LAMELLA CARD

(75) Inventor: Mordeckai Mouyal, Tel Aviv (IL)

(73) Assignee: B-Moss USA, Inc., New York, NY (US)

( * ) Notice: Subject to any disclaimer, the term of this patent is extended or adjusted under 35 U.S.C. 154(b) by 372 days.

(21) Appl. No.: 10/167,599

(22) Filed: Jun. 12, 2002

(65) Prior Publication Data

US 2003/0230891 A1 Dec. 18, 2003

(51) Int. Cl.
*G09F 1/00* (2006.01)

(52) U.S. Cl. ..... 40/124.01; 40/492; 434/404; 446/149; 446/150

(58) Field of Classification Search ..... 40/124.01, 40/124.09, 124.11, 492; 446/147, 149, 150; 434/404

See application file for complete search history.

(56) References Cited

U.S. PATENT DOCUMENTS 1,603,592 A * 10/1926 Glasner ..... 446/147
2,152,542 A * 3/1939 Gard ..... 446/149
2,749,657 A * 6/1956 Lohnes ..... 446/150
3,199,238 A * 8/1965 Brown ..... 40/488
3,323,242 A * 6/1967 Schoenung ..... 40/492

* cited by examiner

*Primary Examiner*—Gary C. Hoge
(74) *Attorney, Agent, or Firm*—Jeffrey Weiss; Karen Sepura; Weiss & Moy, P.C.

(57) ABSTRACT

The Lamella card consists of a foldable wrapping having at least one sighting window, a first image carrier arranged inside it and a second image carrier comprising at least 4 lamellae inserted in one another. At least one of said lamellae is fitted with a lever, which is guided in a guiding slot, connected to a driving element. The lamellae are arranged in such a way that each lamella is brought under the first folding section and over a second neighboring folding section and can be driven by the motion of the driving element from the covered position of the first folding section over the second neighbouring folding section. Through the movement of the lamellae over a motion track, either the image located on the first image carrier or an image located on the lamellae can be displayed in a sighting window.

31 Claims, 23 Drawing Sheets

Figure 1A:
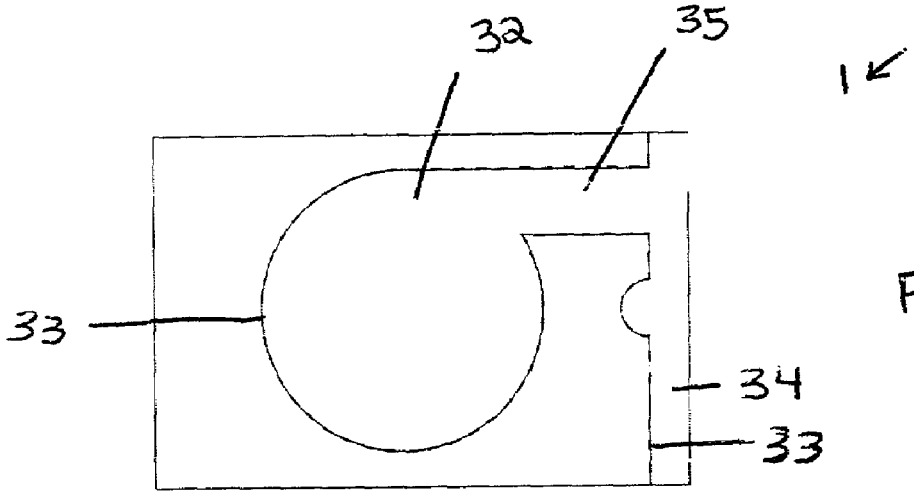
Figure 1C:
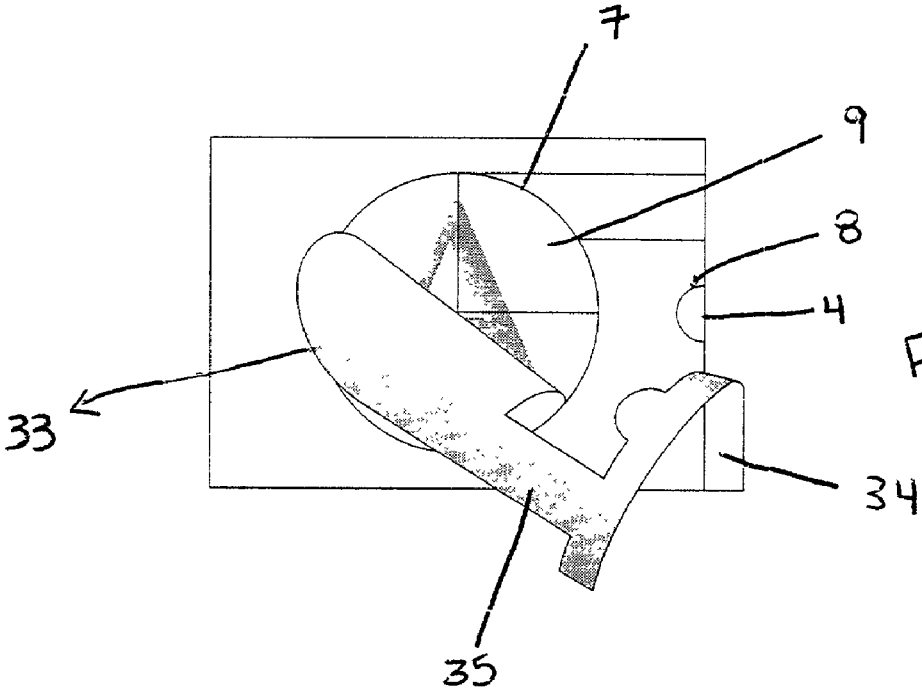
Figure 1B:
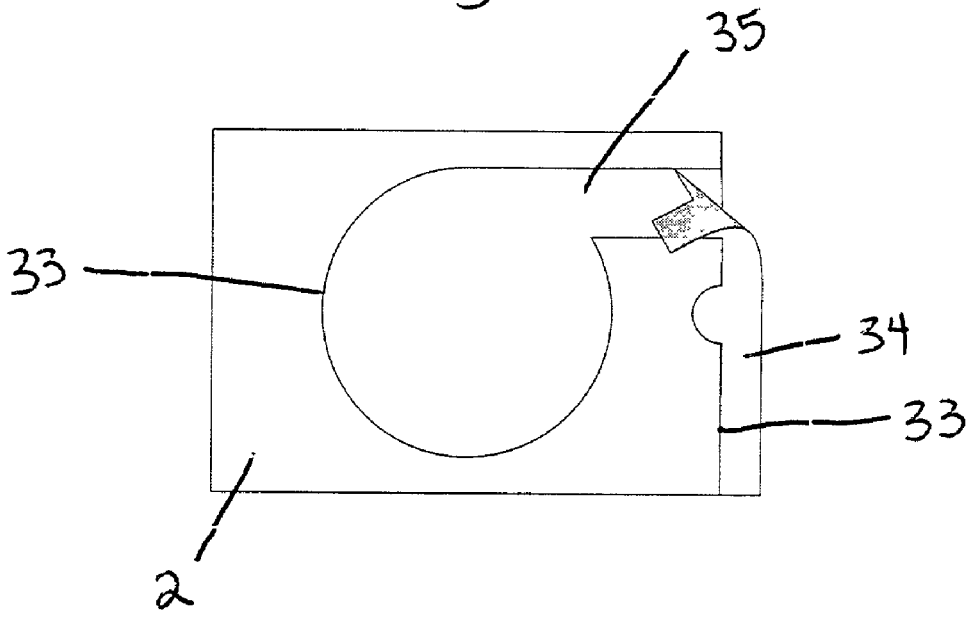

Fig 27
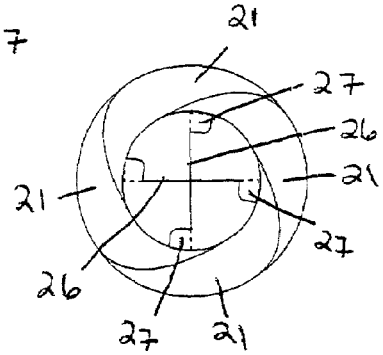
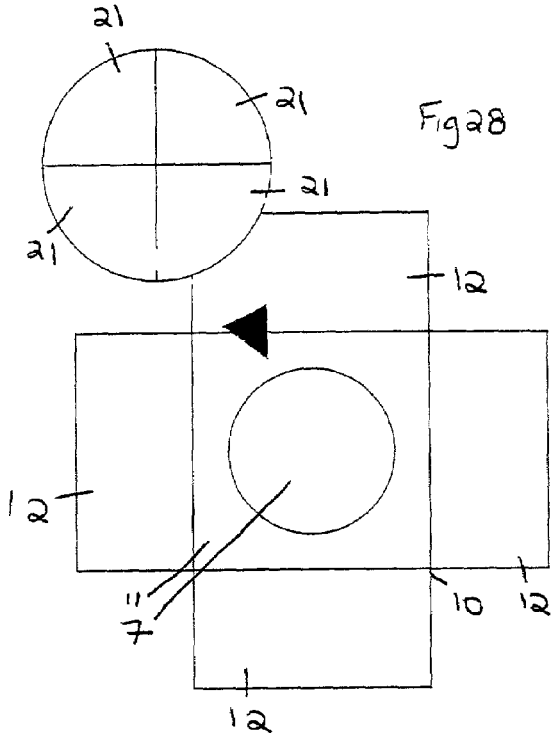
Fig 28
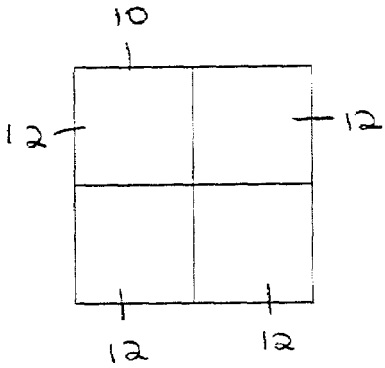
Fig 26

LAMELLA CARD

FIELD OF INVENTION

The invention relates to the field of advertising and promotional techniques and, more particularly to the field of lamella cards. The lamella card consists of a foldable wrapping, a first image carrier and a second image carrier, featuring at least four lamellae, which are movable over a motion track in such a way, that either an image located on the first image carrier or an image located on the lamellae can be displayed in a sighting window.

BACKGROUND OF THE INVENTION

Such lamella cards are used as advertising means in order to draw special attention of the target group applied to, while the target group has to service the advertising means in an active mode with a view to achieve a special impression, which could hook up the advertised product or service to the memory of the target group. Apart from such lamella cards, are also known other advertising means provided with the respective functions; such means generally fall under the concept "Pop-ups".

So, for instance, a lamella "louver" card is referred to in DE 92 16 101 U1. The lamellae of this already known louver card are fastened to a slide shutter with circularly arranged and equally spaced openings. The slide shutter openings are of almost equal size with the lamella openings. A connecting piece protruding through the opening of the slide shutter and the longitudinal opening in the lamellae enables the slide shutter and the lamellae to rotate one with respect to the other in a second connection range and, besides, they can slide jointly along a link. A second connecting piece in the first pivot (of the same design as the connecting piece of the second connection range) is used to fasten the lamellae through a round opening to a holder arranged beneath.

The holder features essentially equal round openings arranged at the places corresponding to the openings of the slide shutter, through which openings the lamella is pivot-connected to the holder. Metal rivets are used as connection pieces. The rivets, which pass through the two openings of the lamella and the respective opening of the holder and of the slide shutter, hold together the parts to be connected due their enlarged ends.

The shortcoming of this already known louver card is the use of metal rivets to fasten the lamella to the slide shutter, since insertion of such rivets in the said louver card is a very labor-consuming operation.

Another louver card, known from DE 200 07 643 U1, having no metal rivets is an excellent advertising means.

Proceeding from this state-of-the-art, the goal of the invention is to conceive such a lamella card, which could be made in a simple and cost-saving way of merely one single material and could, besides, be suitable for a variety of advertising forms especially in the imaging domain.

The solution of this kind of task is provided by the lamella card characterized by the features of claim item 1.

The lamella card according to the invention consists of a foldable wrapping having at least one sighting window, of a first image carrier arranged inside the wrapping and made of a folding element having a central section and four folding sections, which alternately overlap the central section fitted with a guide slot. A second image carrier consists of at least four lamellae inserted into one another, at least one of these lamellae having a lever sliding in the guide slot being connected with a driving element. The lamellae are arranged between the central section and the folding sections in such a way that every one lamella gets under one first folding section and over the second neighboring folding section and can be shifted by the motion of the driving element from the position under the first folding section to the position over the second neighboring section.

The lamellae of the lamella card according to the invention are every time driven by the driving element from the initial position under the first folding section to the second position, where the lamellae are positioned over the neighboring folding section, so the image placed on the lamella can be seen, while in the initial position an image placed on the folding section is visible and becomes hidden in the second position of the lamella. Both the images can be seen through the sighting window.

As the lamella moves from the second position to the initial position, the image placed on the folding section becomes visible again and the lamellae are set in position overlapped by the folding sections.

The driving element is, preferably, a drawing element arranged and guided inside the wrapping.

In particular, the driving element designed as drawing element takes for example the form of an envelope with inserted data carrier card, thus enabling to considerably enlarge the surfaces available for advertising.

An alternative implementation version of the invention envisages the driving element shaped as a revolving wheel or sector thereof. This version features the advantage of a very precise control and guiding of the lamellae, providing a very uniform transition between the two image surfaces during the motion process.

For this implementation version it is preferably envisaged that the revolving wheel, respectively the sector thereof, be connected at least with one lamella.

In addition, for this implementation version it is preferred to have the revolving wheel or the sector thereof fitted with a raster on the rim side that should protrude at least partially. This raster makes it easier to move the lamella even at new lamella cards, whose components are still very tightly interconnected and feature, therefore, high friction.

According to another characteristic feature of the invention, every lamella has at least one straight edge and the edges of the assembled lamellae are square to one another.

Further, it is envisaged that the first image carrier should have a square central section and rectangular folding sections, the lengths of which correspond to the lengths of the edges of the central section and their width to half the edge length of the central section.

The second image carrier shall preferably be circular.

A valuable make of the lamella card according to the invention can be achieved by designing the foldable wrapping as a one-piece folding element, equipped at the very beginning with the prepared folding element exhibiting the lamella, subsequently folded and finally glued on.

According to another characteristic feature of the invention, it has turned out that in order to fit the second image carrier, it is preferably to make the sighting window a round one with a diameter corresponding to the diameter of the second image carrier.

The motion precision of the two image elements moving together can be improved by connecting mechanically the first image carrier with the wrapping element, preferably using glue and/or suitable elements as, for instance, pins or insertion holes.

In order to protect the image elements at shipping the lamella cards and to increase the advertising appeal, respectively the advertising effect, it is envisaged to cover the sighting window with a removable cover.

It can be additionally planned to cover the driving element with a removable cover in order make sure that the advertising message will get to and be assessed by the intended target person in the proper succession with no modification during transport. Generally, a message is appended to the two image elements, which stresses the importance of the proper viewing succession of the two image elements.

The cover is made fit for tearing off along a perforation in order to simplify its removal.

To simplify handling of the lamella card and to avoid requiring too much preparatory work and thoughtful activities of the target person, which results in non-assessment of the advertising message, it is envisaged to interconnect both covers making them a one-piece item.

Finally, according to another characteristic feature of the invention, the first image carrier is a component of the foldable wrapping, consisting of the central section with sighting window and the folding sections. This implementation version enables to diminish the number of separate components of the lamella card resulting in a beneficial production cost.

Additional characteristic features and advantages of the invention can be seen from the following description of the pertaining drawings, which show a preferred implementation form of a louver card.

SUMMARY

In accordance with the present invention, the Lamella card consists of a foldable wrapping having at least one sighting window on one side, a first image carrier arranged inside it, a second image carrier comprising at least 4 lamellae inserted in one another, whereby at least one of these lamellae is fitted with a lever, which is guided in a guiding slot, connected to a driving element. The lamellae are arranged in such a way that each lamella is brought under the first folding section and over a second neighboring folding section and can be driven by the motion of the driving element from the covered position of the first folding section over the second neighbouring folding section. Through the movement of the lamellae over the motion track, either the image located on the first image carrier or an image located on the lamellae can be displayed in a sighting window.

DRAWINGS

The drawings represent:

FIGS. 1*a-h* A first implementation form of the lamella card in various successive operating positions. General view.

Figure 1D:
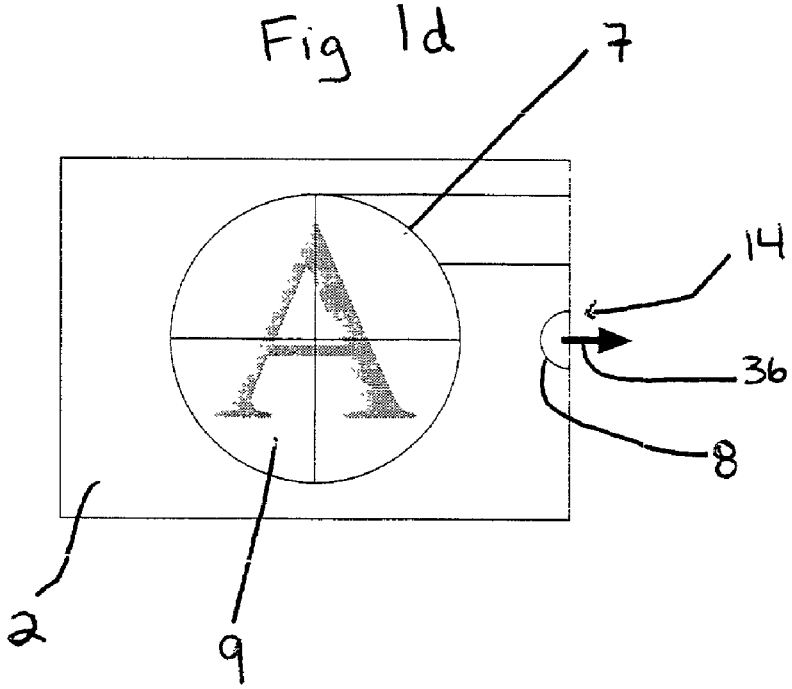
Figure 1E:
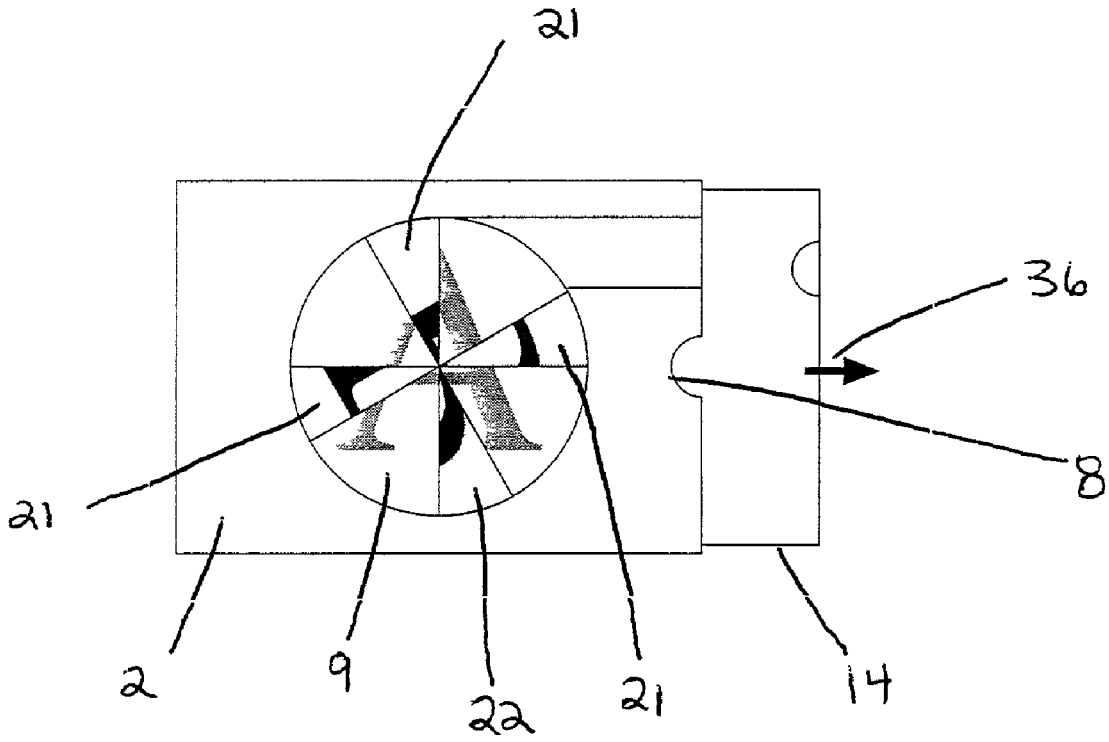
Figure 1F:
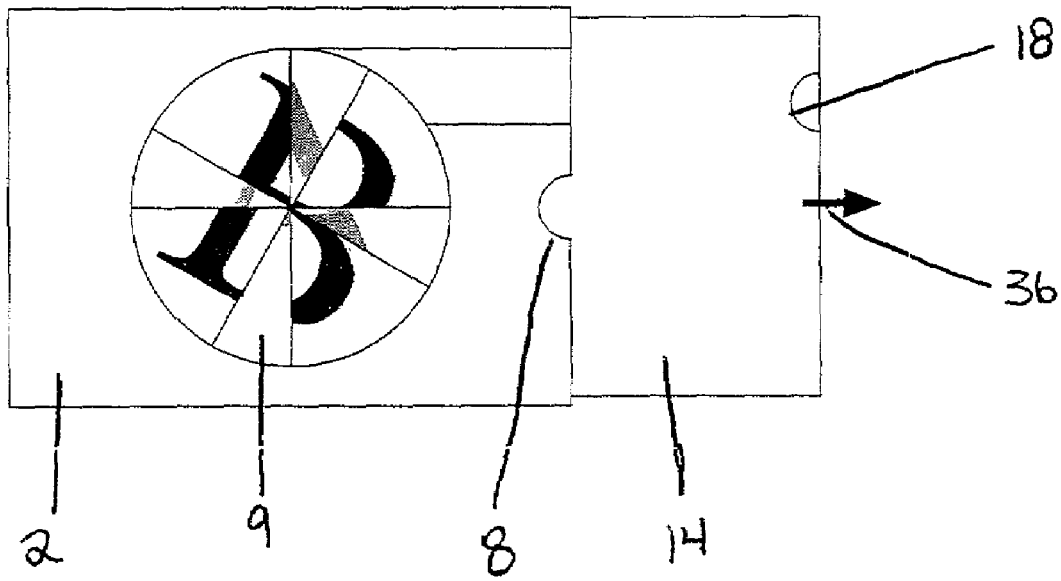
Figure 1G:
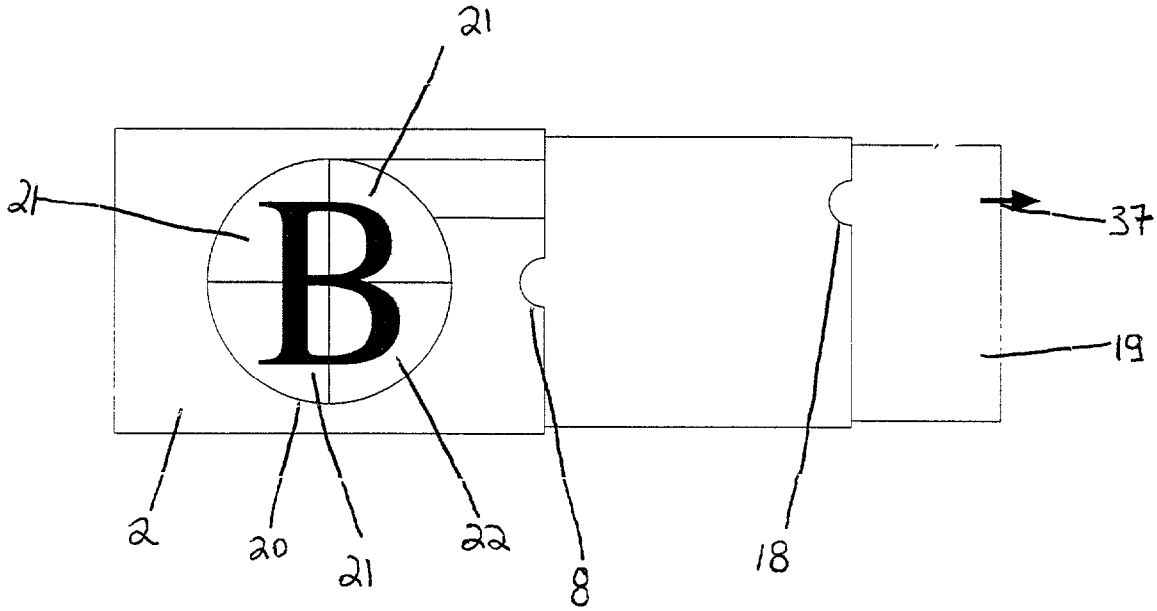
Figure 1H:
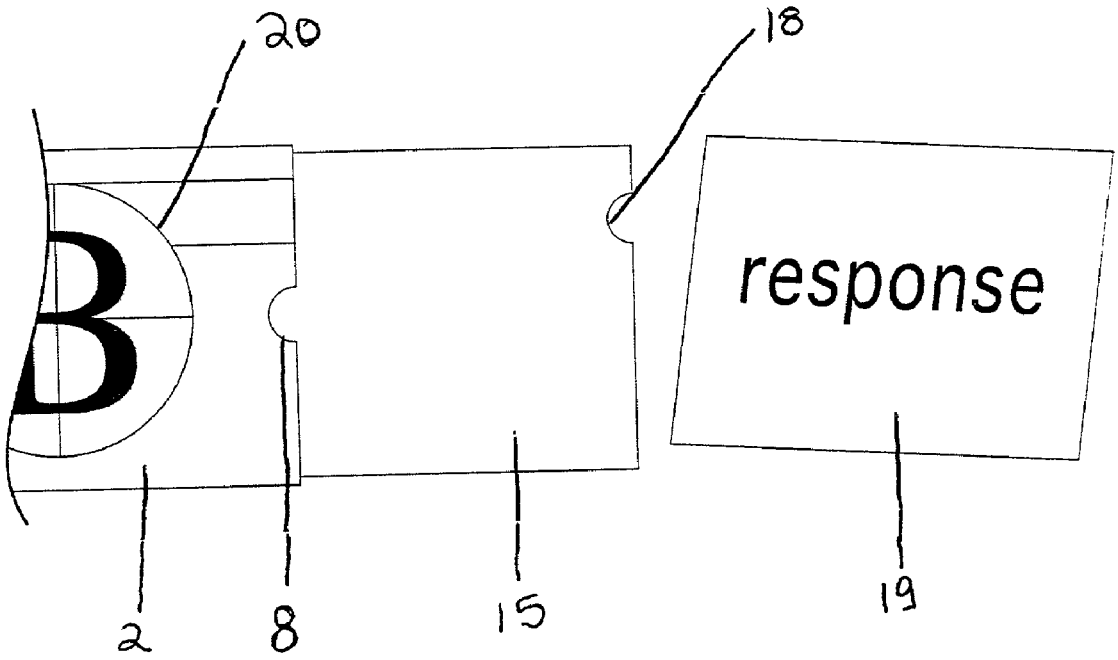
Figure 2:
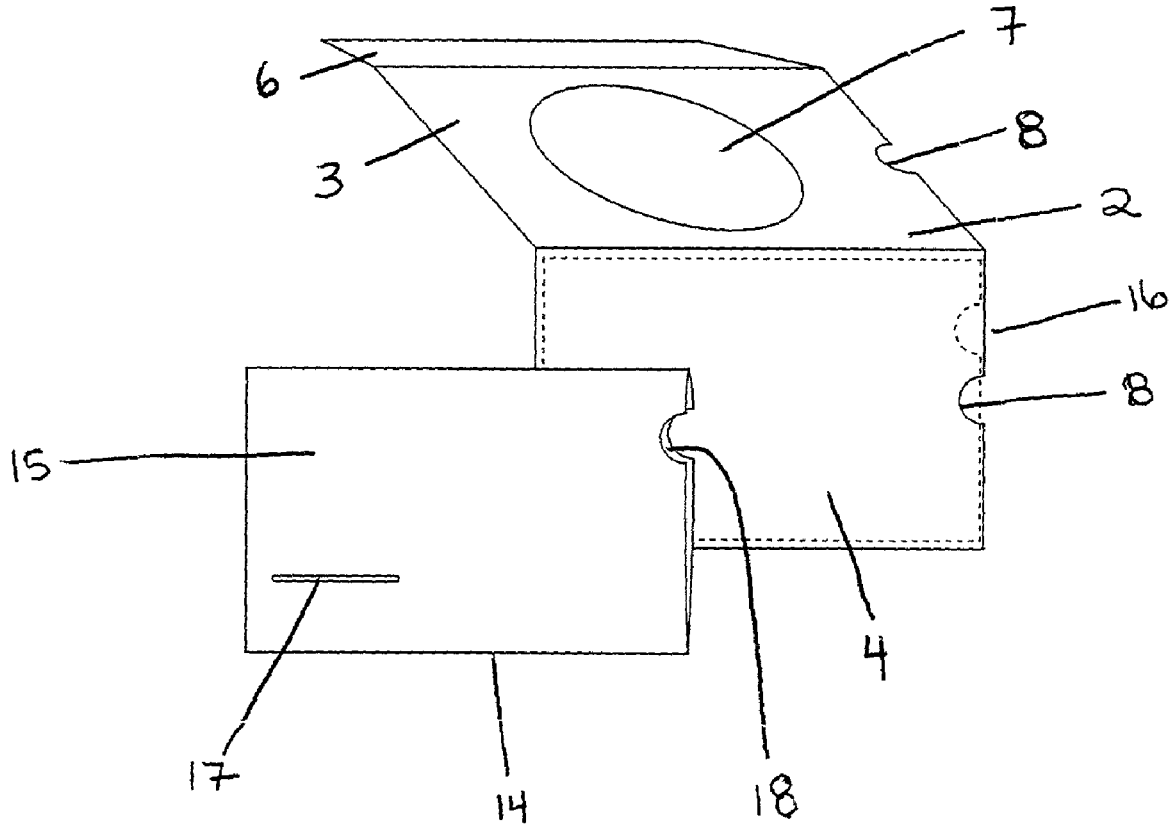

FIG. 2 Lamella card with a driving element according to FIG. 1. Open perspective view.

Figure 3:
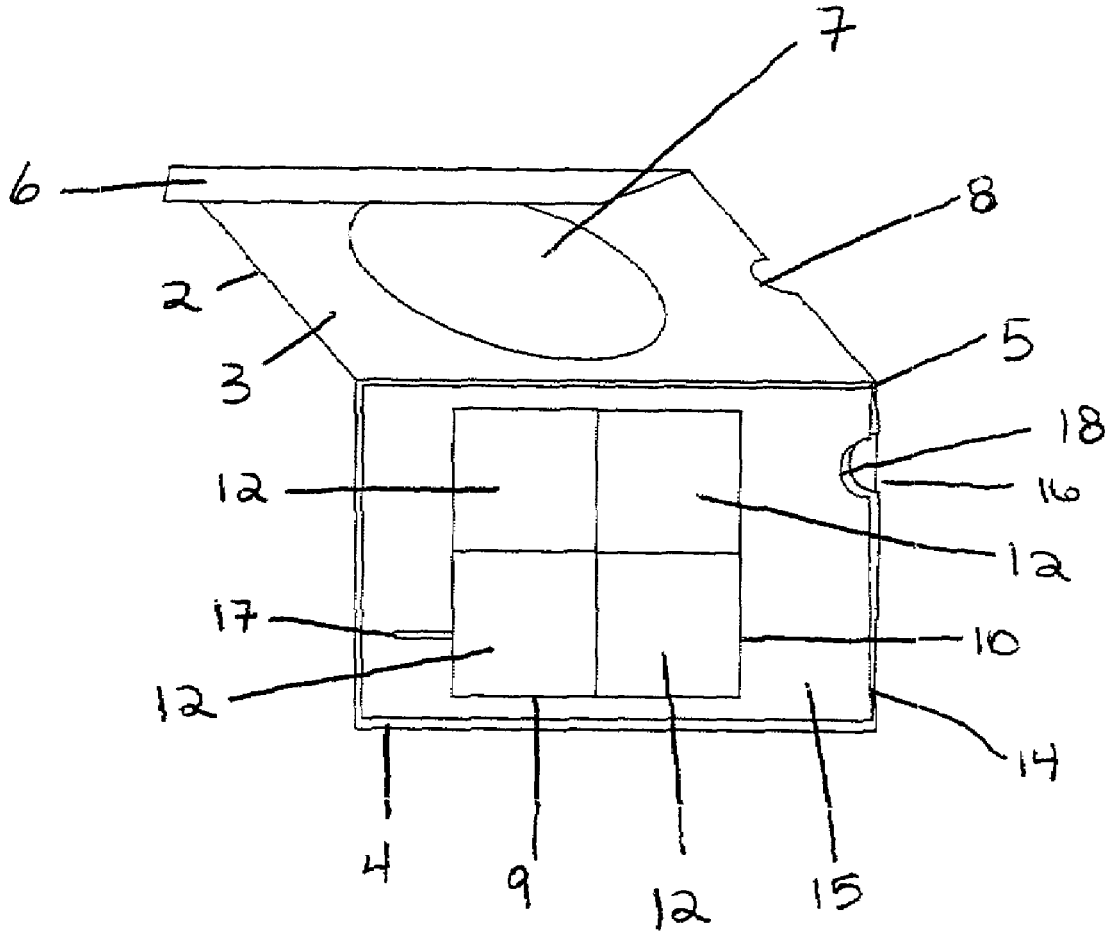

FIG. 3 Lamella card according to FIG. 2 with an inserted folding element. Open perspective view.

Figure 4:
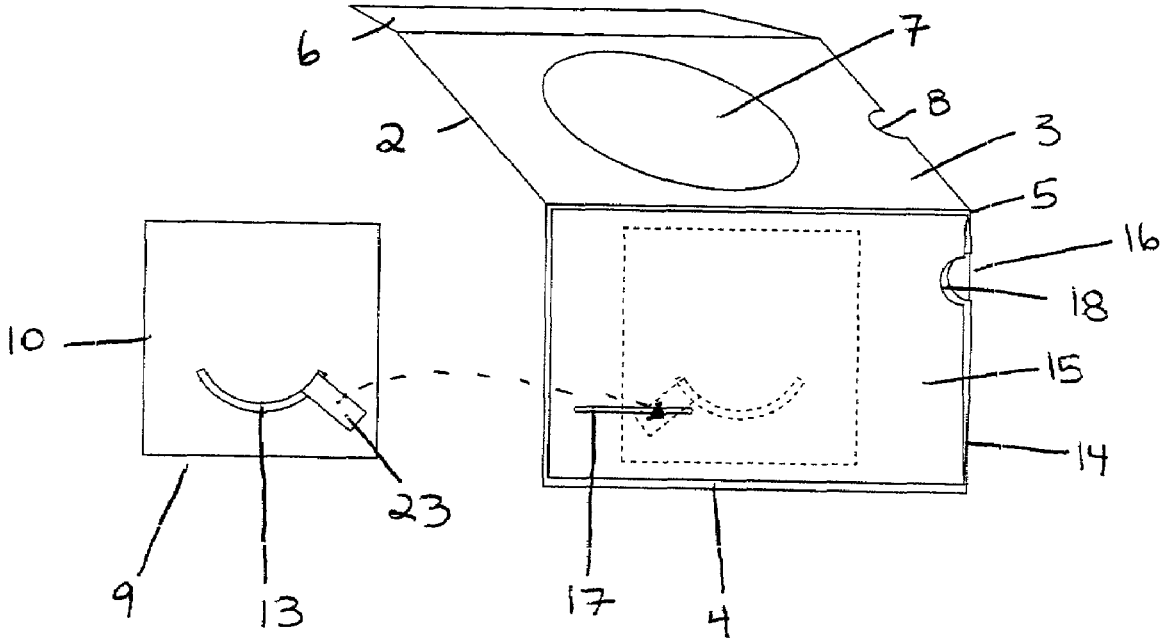

FIG. 4 Lamella card with the folding element according to FIG. 3. Rotated view.

Figure 5:
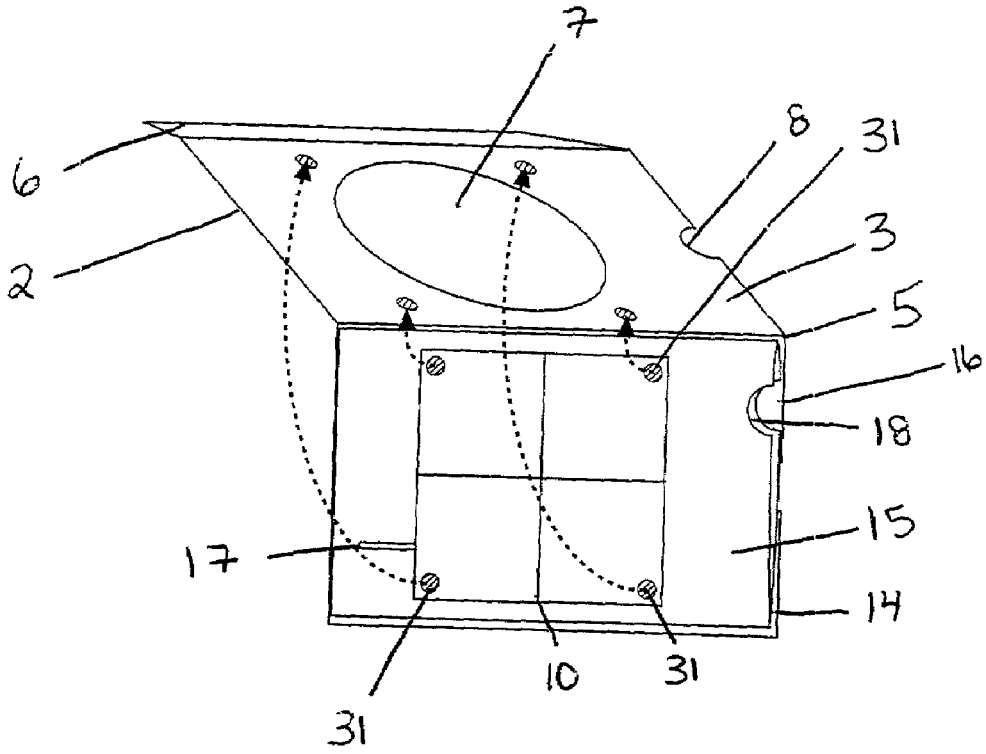

FIG. 5 Lamella card according to FIG. 3. Open perspective view.

Figure 6:
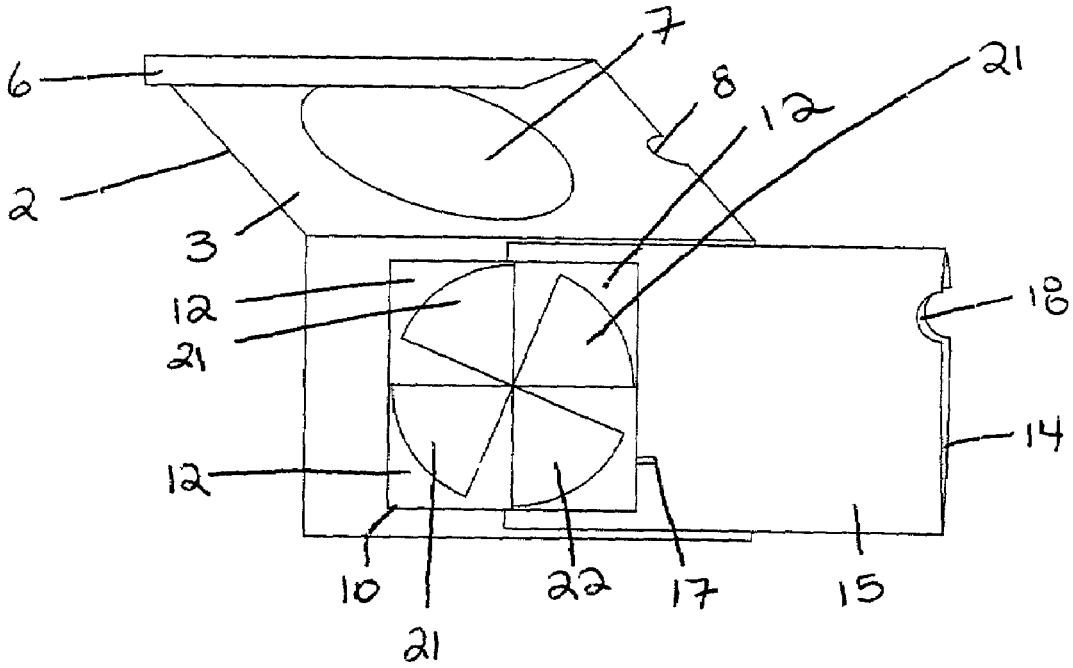

FIG. 6 Lamella card according to FIG. 3 with partially withdrawn driving element. Open perspective view.

Figure 7:
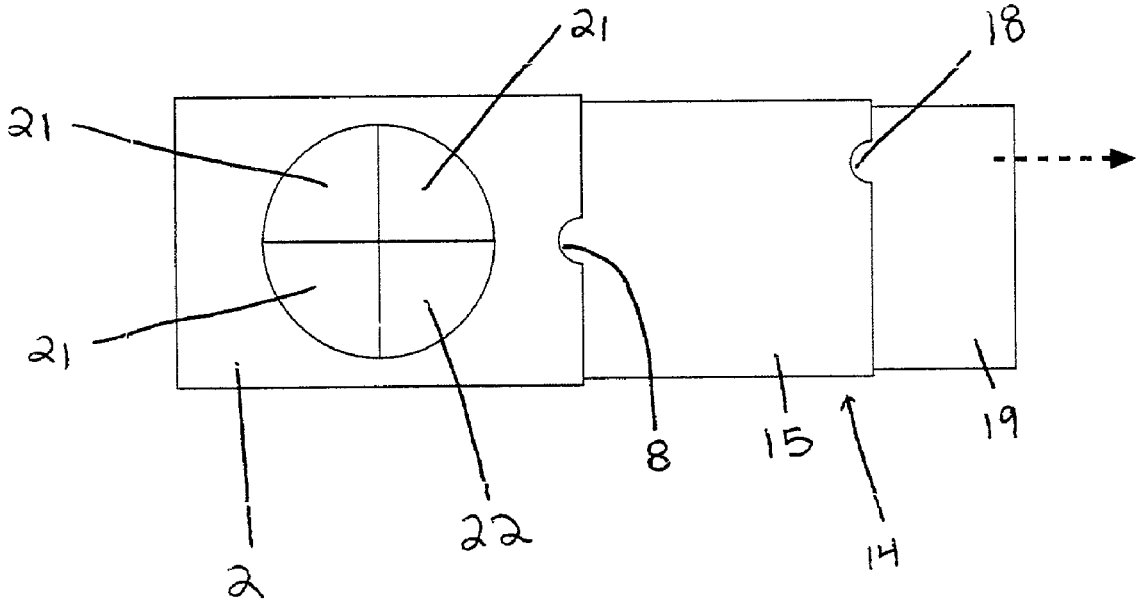

FIG. 7 Lamella card according to FIG. 3 with partially withdrawn driving element. Closed view.

Figure 8:
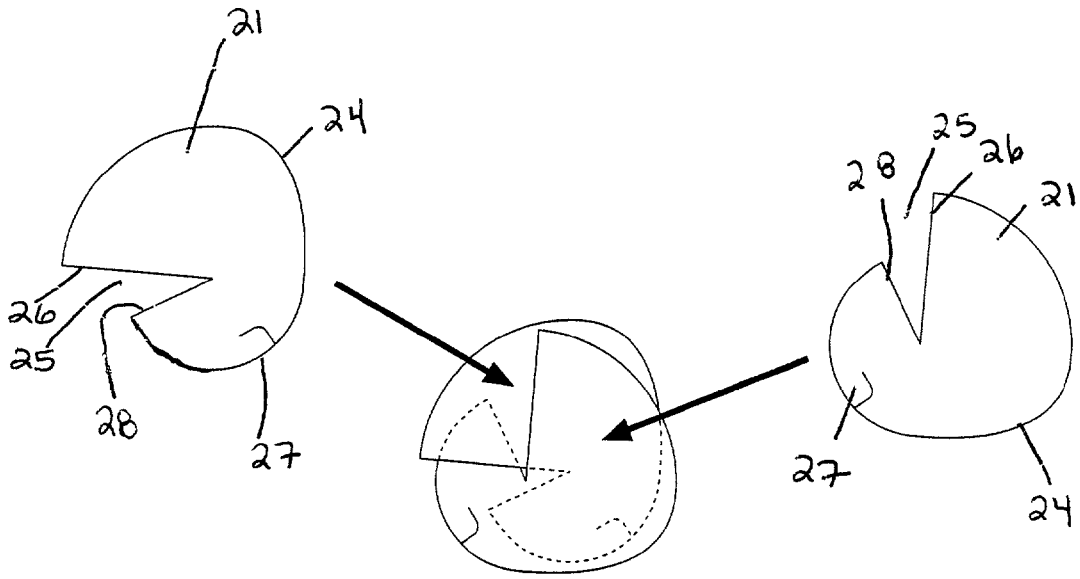
Figure 9:
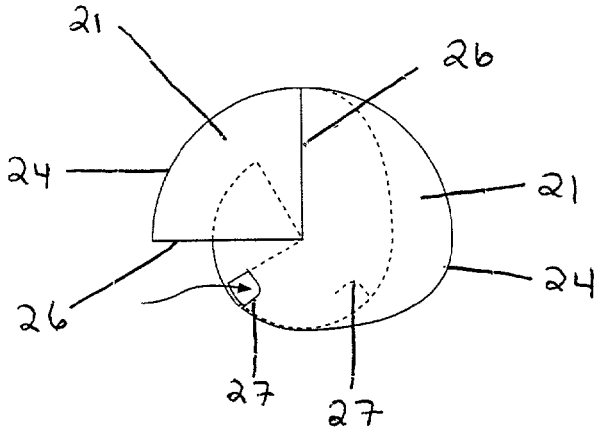

FIG. 8 Two lamellae of the lamella card according to FIG. 1, viewed separately and in assembled position FIG. 9 Lamellae according to FIG. 8 in assembled and interconnected position. General view.

Figure 10:
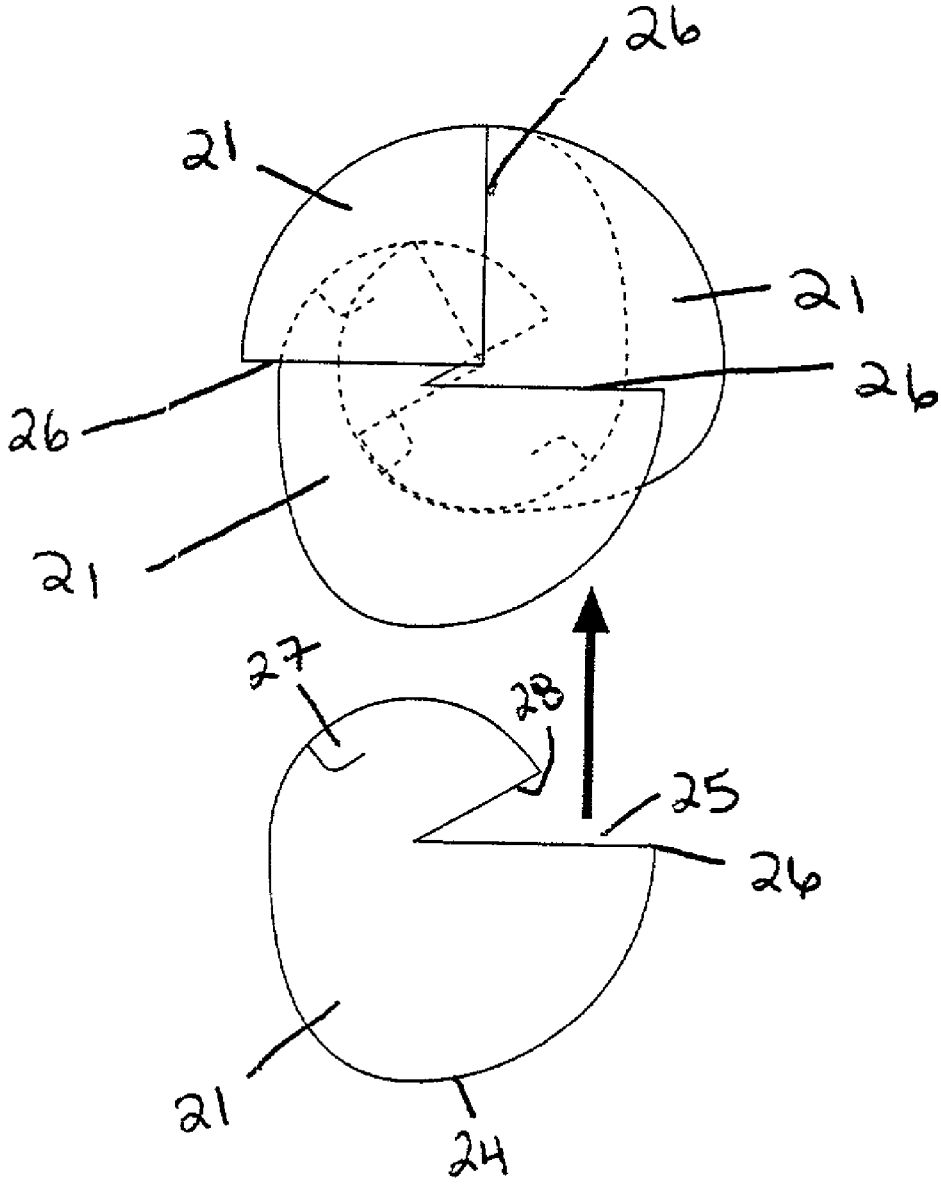

FIG. 10 Lamellae according to FIG. 8 with a third lamella. General view.

Figure 11:
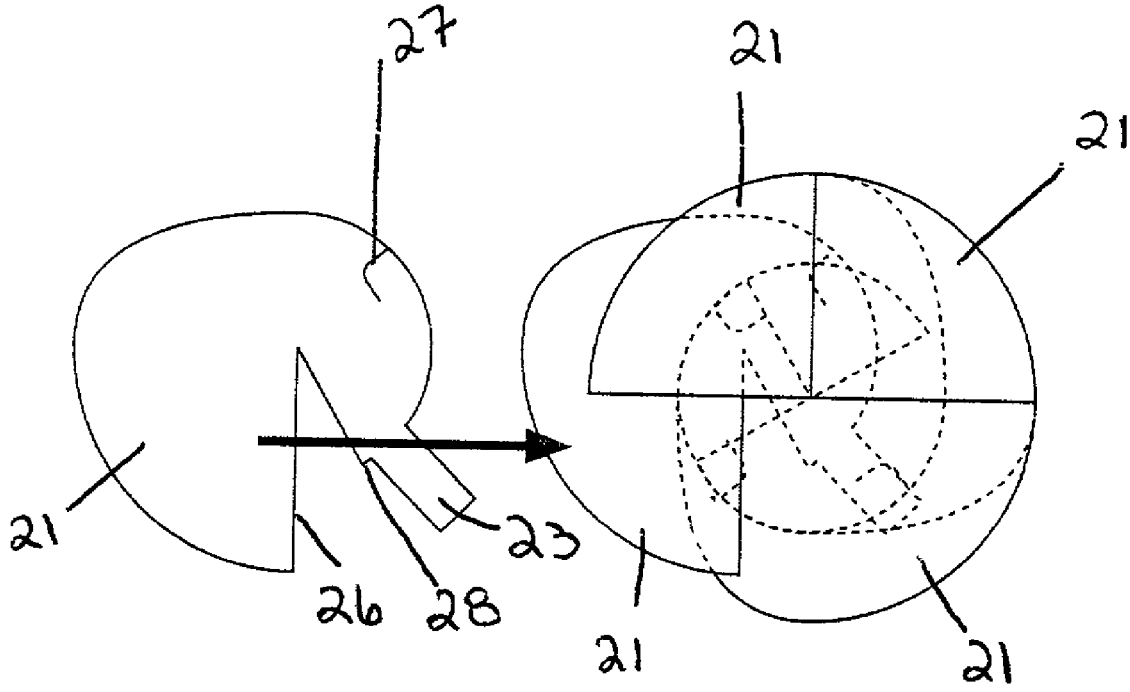

FIG. 11 Three lamellae according to FIG. 10 with a fourth lamella. General view.

Figure 12:
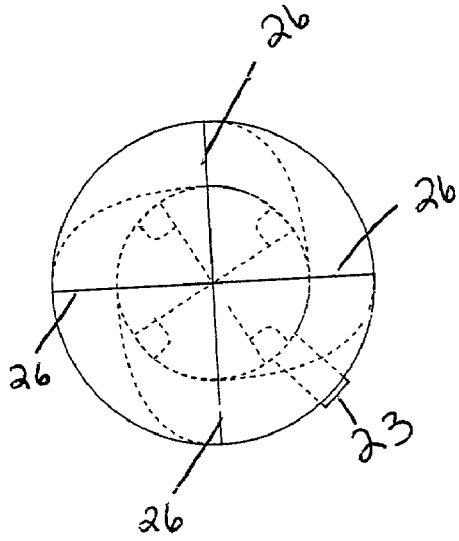

FIG. 12 Assembled lamellae according to FIG. 11. Front view

Figure 13:
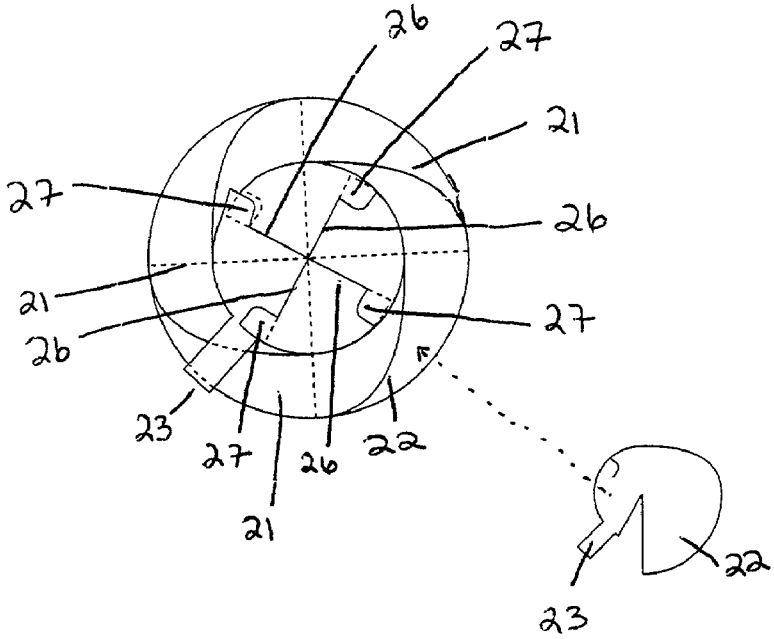

FIG. 13 Assembled lamellae according to FIGS. 11 and 12 with detailed representation of the fourth lamella. Rear view.

Figure 13A:
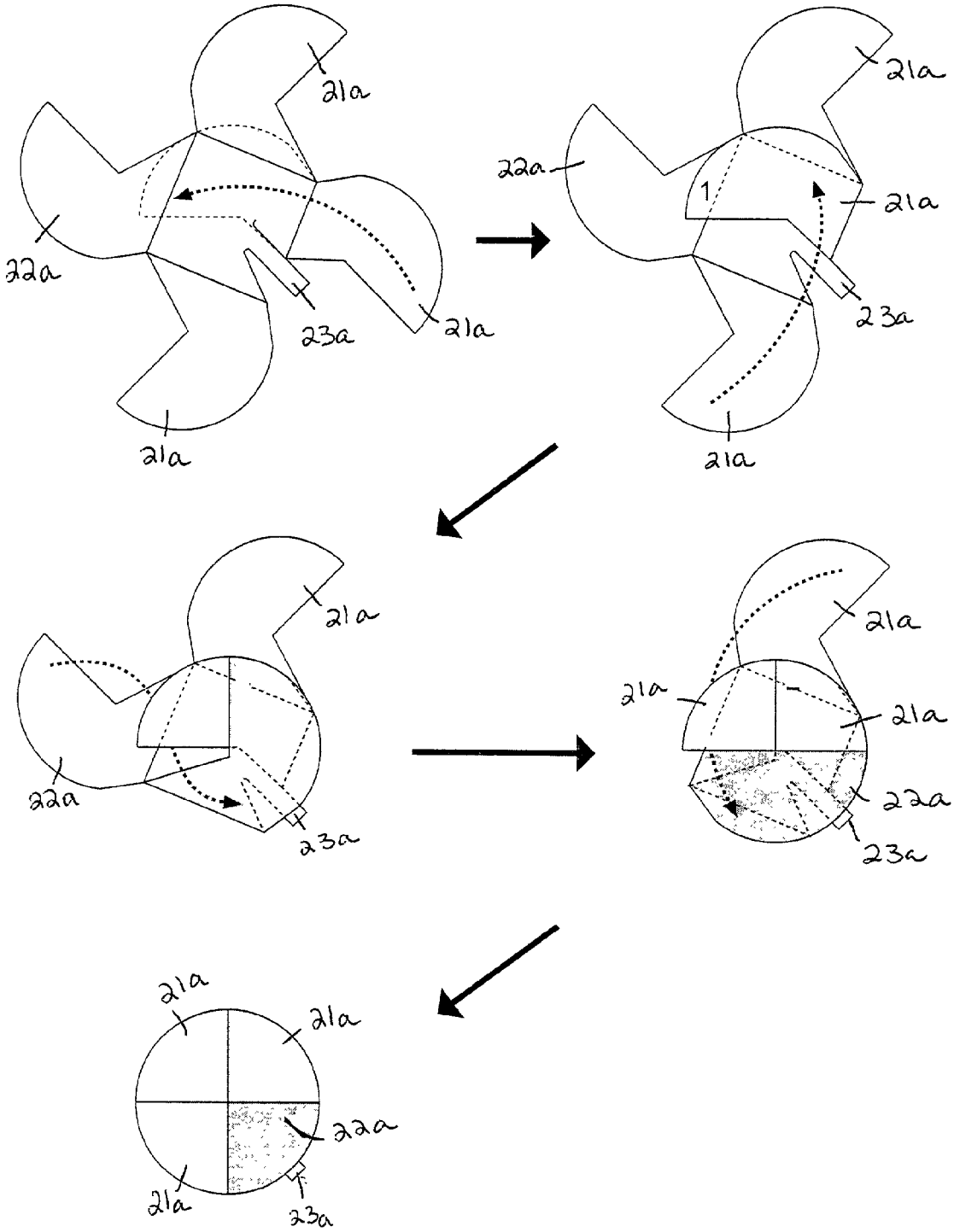

FIG. 13*a* Additional implementation of the lamellae, made of one piece. View of the assembly of the one-piece lamellae.

Figure 14:
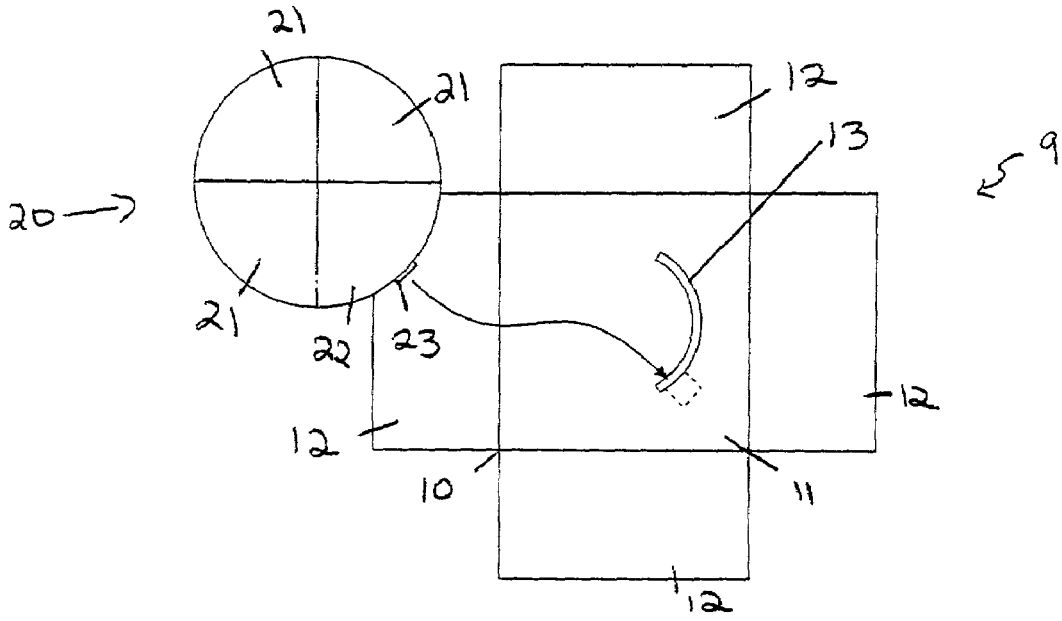

FIG. 14 Folding element according to FIG. 3 in open position with the four lamellae according to FIGS. 11 through 13. General view.

Figure 15:
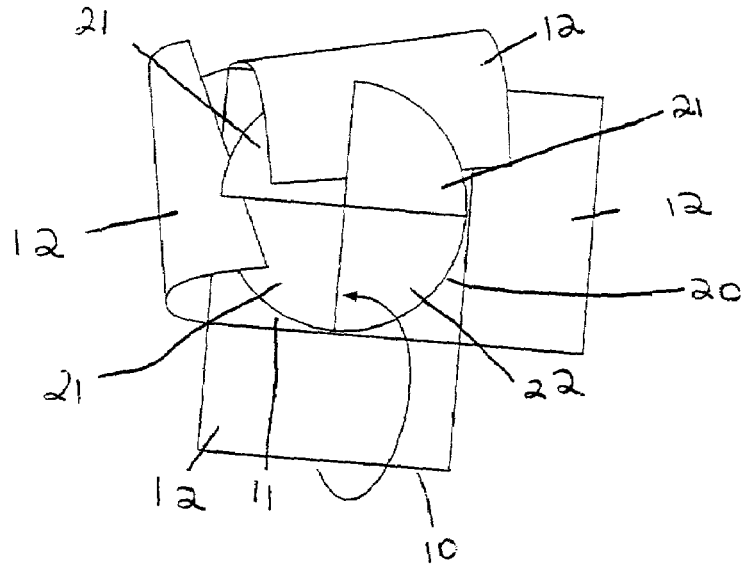

FIG. 15 Folding element with four lamellae according to FIG. 14 in the first folding position. Perspective view.

Figure 16:
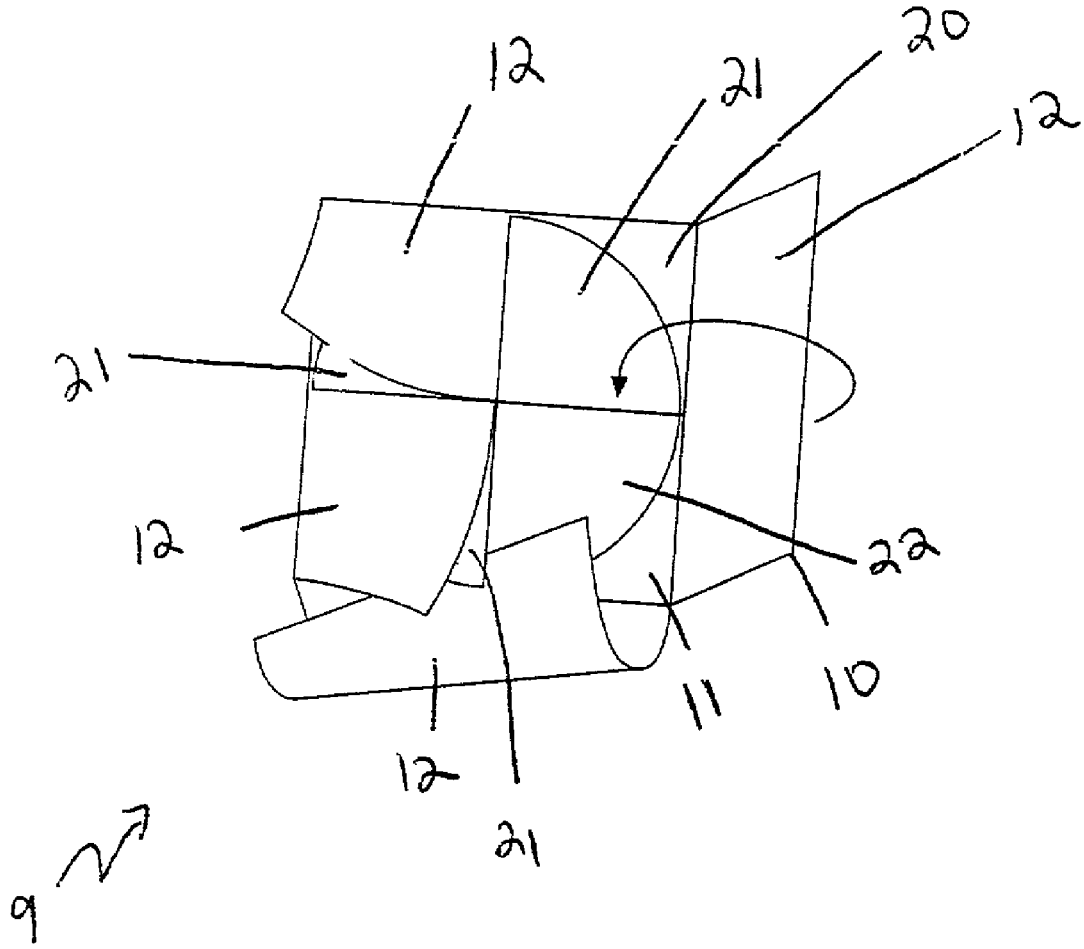

FIG. 16 Folding element with four lamellae according to FIG. 14 in the second successive folding position. Perspective view.

Figure 17:
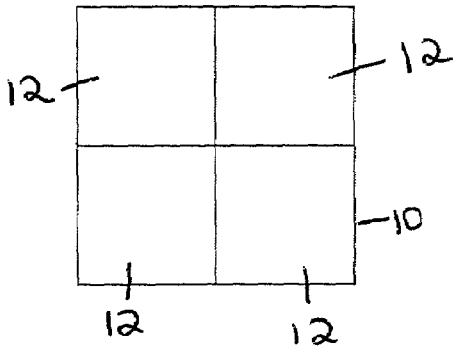

FIG. 17 Folding element with four lamellae according to FIGS. 14 through 16 in folded position. Front view.

Figure 18:
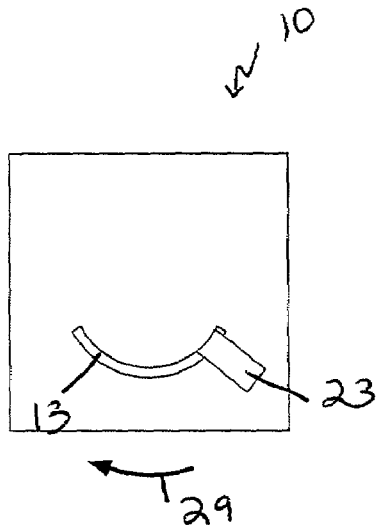

FIG. 18 Folding element according to FIG. 17. Rear view.

Figure 19:
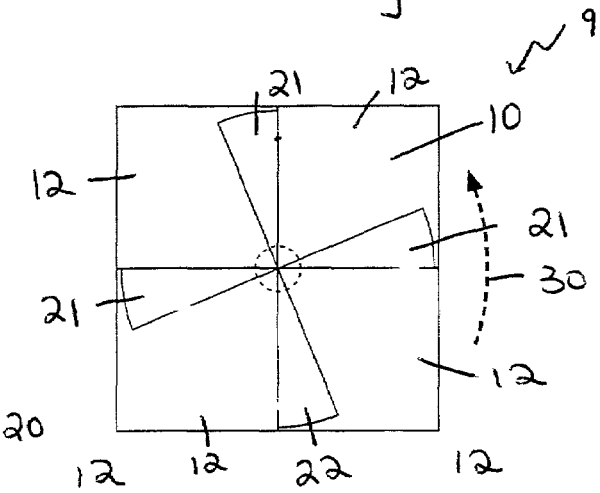

FIG. 19 Folding element according to FIG. 17 with somewhat turned lamellae. General view.

Figure 20:
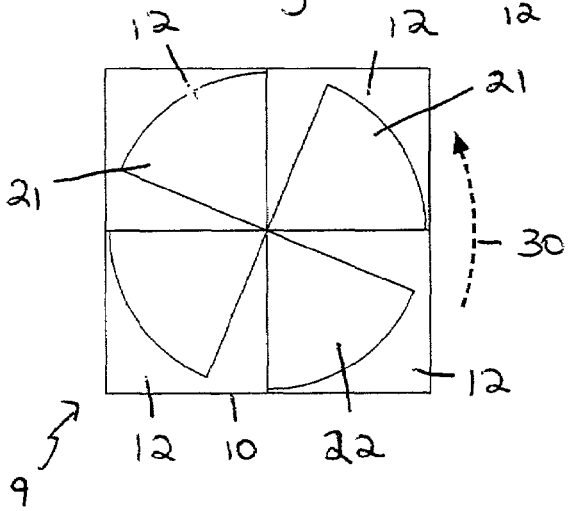

FIG. 20 Folding element according to FIG. 19 with somewhat more turned lamellae. General view.

Figure 21:
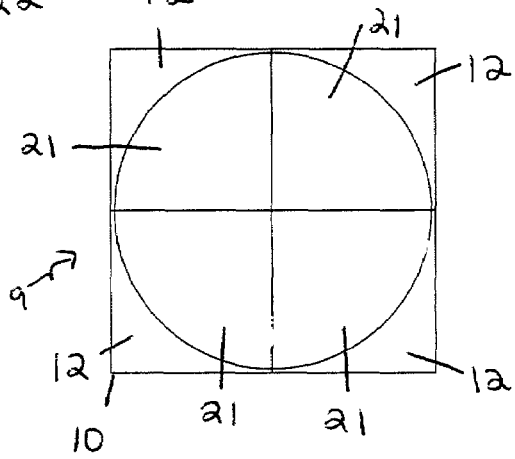

FIG. 21 Folding element according to FIG. 19 with fully turned lamellae. General view.

Figure 22:
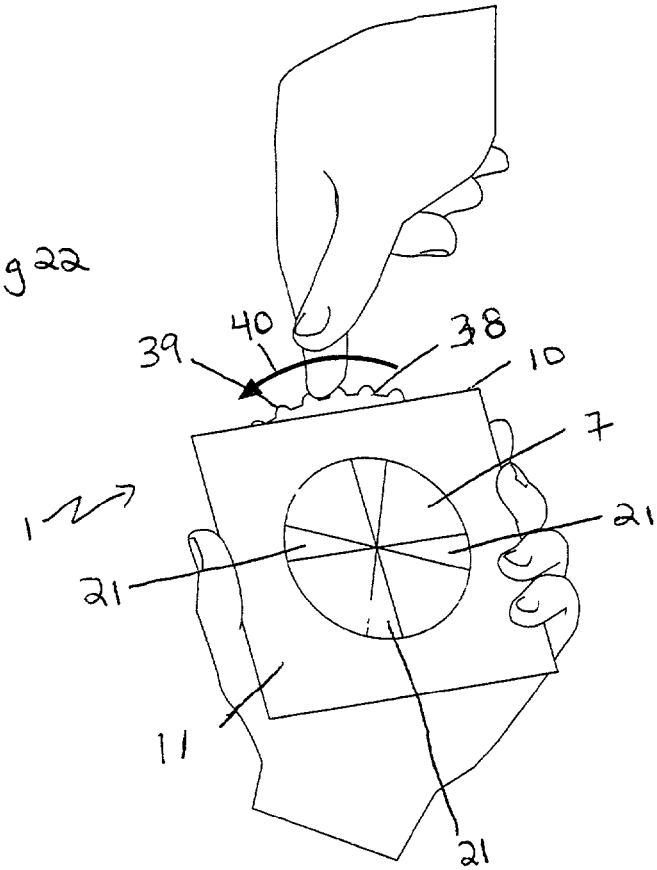

FIG. 22 A second implementation form of the lamella card. Perspective view.

Figure 23:
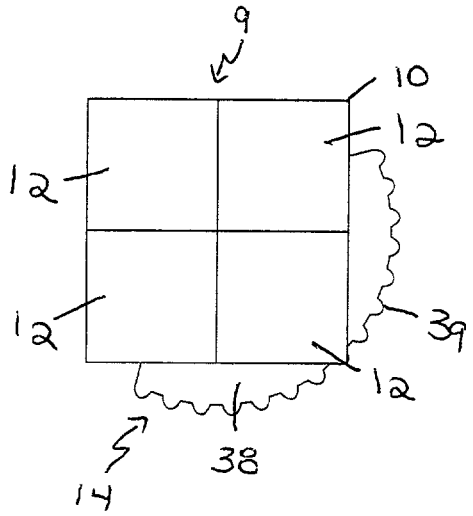

FIG. 23 Lamella card according to FIG. 22 with lamellae in the first position. General view.

Figure 24:
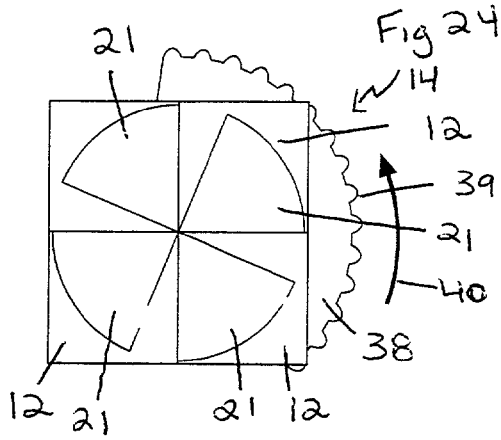

FIG. 24 Lamella card according to FIGS. 22 and 23 with lamellae in the second position. General view.

Figure 25:
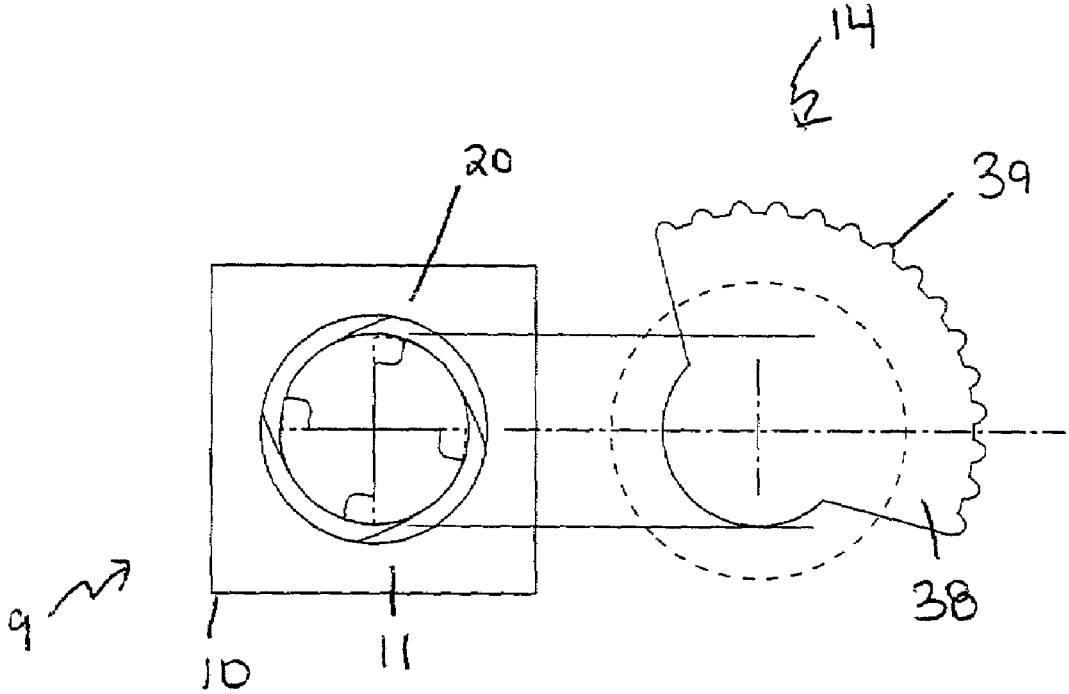

FIG. 25 Lamella card according to FIGS. 22 through 24 with disconnected driving element. Rear view.

FIG. 26 Folding element of the lamella card according to FIGS. 22 through 25. Front view.

FIG. 27 Four lamellae of the lamella card according to FIGS. 22 through 25. Rear view FIG. 28 Folding element according to FIG. 26 in open position with four lamellae according to FIG. 27. Front view.

DETAILED DESCRIPTION

The FIGS. 1 through 21 represent a first implementation form of the lamella card 1. The lamella card 1 consists, according to FIG. 3, of an foldable wrapping 2, designed as a one-piece folding element featuring a first half 3 and a second half 4, which are interconnected at one folding edge. The first half 3 of the wrapping 2 has a glued fold 6, which is glued on to the second half 4 as the two halves 3 and 4 fold up.

A round-shaped sighting window 7 is arranged in the first half of the wrapping 2. Additionally, there is a recess 8 in the zone of the first half 3, which recess arranged on the narrow side of the wrapping 2 is meant as a finger nest.

The first image carrier 9 is arranged on the second half 4 of the wrapping 2. The image carrier consists of a folding element 10, which, according to the FIGS. 14 through 16, is composed of a central section 11 and four folding sections 12. The central section 11 is square-shaped. The central section is fitted with a circular-arc slot 13, whose function will be described below.

A folding section 12 is hinged to each edge of the central section 11, the length of the folding section 12 corresponds to the edge length of the central section 11. The width of each folding section 12 equals half the edge length of the central section 11.

Further, the lamella card comprises a driving element 14, designed for the implementation according to FIGS. 1 through 21 as a drawing element in the form of an envelope 15. The dimensions of the envelope 15 correspond essentially to the clear dimensions of the closed wrapping 2 and the envelope 15 can be withdrawn at some extent from the wrapping 2 over the side marked 16. The envelope 15 shows a slot-shaped opening 17 arranged in the direction of the motion of the envelope 15. The function of this opening will be described hereinafter.

The envelope 15 has also a recess 18 in the form of a finger nest. This recess 18 enables seizing and withdrawing from the envelope 15 the card 19 represented in FIG. 7, formerly inserted in the envelope 15.

Referring to FIGS. 14 through 16, it can be seen that a second image carrier 20 is arranged inside the first image carrier 9. The second image carrier 20 consists of four lamella 21, respectively 22. The second image carrier is round-shaped and the diameter of the second image carrier 20 corresponds to the edge length of the central section 11 and to the diameter of the window 7.

The lamellae 21, respectively 22, are inserted into one another and designed according to the FIGS. 8 through 13 respectively to fit one another. The lamella 22 has a lever 23, which enters the slot 13 and also the opening 17 in the envelope 15 to provide the motion of the second image carrier 20 with respect to the first image carrier 9, which motion will be subsequently described.

FIG. 8 represents two identical lamellae separately and in assembled position. Each lamella 21, respectively 22, features a circular-arc outer contour 24, this contour being broken by a V-shaped notch 25. Each notch 25 has a prolonged straight edge 26.

In addition, within the range of the outer contour 24 of each lamella 21 and 22 there is a L-shaped cut 27 intended to interconnect the separate lamellae 21, 22.

FIG. 9 shows the position of the two lamellae 21 described above and represented in FIG. 8, before adding the third lamella 21 according to FIG. 10. The design of the third lamella 21 added in FIG. 10 is the identical with the above-described lamellae 21 and, hence, one can refer to the abovementioned description related to FIG. 10. The FIG. 11 represents the lamella 22 with lever. Essentially the design of the lamella 22 corresponds to the design of lamellae 21 described before, however the lamella 22, as already mentioned, has an additional lever 23 in the zone of the shorter edge 28 of the V-shaped cut. The lever 23 is of rectangular shape and extends mainly in the radial direction toward the lamella 22.

The FIGS. 12 and 13 show the arrangement of the four lamellae 21, respectively 22, in assembly. It shall be mentioned that the edges 26 of the neighboring lamellae 21 and 22 are square to one another.

The FIG. 13*a* illustrates a different implementation of the assembly of the four lamella 21*a* 22*a* through it being created of one single piece. The assembly of this follows the same description as that of FIGS. 8 through 13 with the difference being that the lamellae 21*a* 22*a* and the lever 23*a* are all created of one piece.

FIGS. 15 and 16 show the integration of the second image carrier 20 into the first image carrier 9. It can be seen that each lamella 21, respectively, 22 of the second image carrier 20 gets over a folding section 12 of the first image carrier 9, respectively of the folding element 10, and under and square to the neighboring folding section 12 of the folding element 10. Thus, according to FIG. 17, in the initial position, where the lever 23 of the lamella 22 according to FIG. 18 is at the one end of the slot 13 of the folding element 10, all the lamellae 21, respectively 22, are fully covered by the folding sections 12 of the folding element 10. By moving the lever 23 in the direction of arrow 29 shown in FIG. 18 along the slot 13, the lamellae 21, respectively 22, according to FIG. 19, are turned from their covered position under a folding section 12 to the neighboring folding section 12 of the folding element 10. The motion direction of the lamellae 21, respectively 22, is shown on FIGS. 19 and 20 by the dashed arrow. FIG. 20 shows a position of the lamellae 21, respectively 22, at almost completed travel of the lever 23 along the slot 13, where the lever 23 is no more in the zone of the right end of the slot 13 shown on FIG. 18, but is positioned almost at the left end of the slot 13.

With the lever 23 positioned at the left end of the slot 13 according to FIG. 18, the lamellae 21 and 22 are fully shifted from the covered position under the folding section 12 to the neighboring folding section 12 and they cover fully the folding sections 12, so the image placed on the lamellae 21 and 22 becomes visible through the sighting window 7.

According to FIG. 5, the folding elements 10 has gluing-on points 31 at the corners and, thus, the folding element 10 is glued-on to the first half 3 of the envelope 2 and maintained exactly in the proper position inside the envelope 2, while the envelope 15 can be withdrawn from the envelope 2 at some extent.

In order to move the lamellae 21, respectively 22, the lever 23 enters the opening 17. When the envelope 15 is withdrawn from the envelope 2, the lever 23 reaches the end of the opening 17 and, hence, at further motion of the envelope 15, the lever 23 moves along the slot 13 resulting in the lamellae 21 and 22 are brought over the neighboring folding sections 12 from their covered position to the neighboring folding sections 12 in the previously described mode.

The FIGS. 1*a* through 1*h* show the motion process of the lamella card 1 according to the invention. In addition, it can be seen that the sighting window 7 is covered by a cover 32 fastened to the envelope 2. This cover can be torn off along the perforation line 33. Besides, in the motion range of the driving element 14, there is also a removable cover 34, which can as well be torn off from the foldable wrapping 2 along the perforation line 33. The covers 32 and 34 are interconnected by a strap, so they represent a one-piece item and can be removed by a single tearing off.

After having removed the covers 32 and 34 according to FIG. 1*d*, the first image carrier 9 with the first image marked "A" can be seen in the sighting window 7. Now, if the driving element 14 is seized in the range of the recess 8 and withdrawn from the wrapping element 2 in the direction of the arrow 36, the lamellae 21, respectively 22, of the second image carrier 20 are pulled, according to FIG. 1*e*, over the first image carrier 9 until the lamellae 21, respectively 22 are fully brought over the first image carrier 9, and the second image carrier 20 displays the second image marked "B" in the sighting window 7.

Finally, the card 19 can be withdrawn from the driving element 14 in the direction of the arrow 37. The card 19 can for example be a response card to an advertising enterprise. Should the driving element 14 be reinserted into the wrapping 2, the image carrier 20 replaces the image carrier 9 and, hence, the initial image marked "A" will be visible again.

The FIGS. 22 through 28 represent a second implementation form of the lamella card 1 according to the invention. This second implementation form of the lamella card 1 differs from the first implementation form of the lamella card 1, represented on FIGS. 1 through 21, by the driving element 14 being designed not as a drawing element but as a rotary element, as a revolving wheel. This revolving wheel is fitted on the rim with a raster 39 and connected with a lamella 21. In addition, for this implementation form of the lamella card 1, the first image carrier 9, namely the folding element 10, is not housed in an envelope. The implementation form of the lamella card 1 according to the FIGS. 22 through 28 features the sighting window 7 in the central section 11 of the folding element 10. In other respects, the design of the folding elements 10 and of the lamellae 21 corresponds to the previously described implementation form and reference shall be made to the previous implementation form.

In order to bring the lamellae 21 from their covered position under the folding sections 12 of the folding element 10 to the zone of the sighting window 7, the revolving wheel 38 shall be moved in the direction of the arrow 40, according to the FIG. 22, respectively 24.

It goes without saying that a lamella 22 turns out to be unnecessary for this implementation form, since there is no need for the lever 23. The lever 23 of the implementation form according to FIGS. 1 through 21 is replaced here by the revolving wheel 38, which is connected with the lamella 21.

The invention claimed is:

1. Lamella card consisting of a foldable wrapping (2) having a one sighting window (7), a first image carrier (9) arranged inside the wrapping (2), which image carrier consists of a folding element (10) made of a central section (11) and four folding sections (12) alternately overlapping the central section (11) fitted with a guiding slot (13), and of a second image carrier (20) consisting of four lamellae (21, 22) inserted in one another and one of the lamella (22) is fitted with a lever (23), which is guided in the guiding slot (13) being connected to a driving element (14), and the lamellae (21, 22) are arranged in such a way between the central section (11) and the folding sections (12) that each lamella (21, 22) is brought under a first folding section (12) and over a second neighboring folding section (12) and can be driven by the motion of the driving element (14) from a covered position of the first folding section (12) over the second neighboring folding section (12).

2. Lamella card according to claim item 1, wherein the driving element (14) is designed as a drawing element housed and guided inside the wrapping (2).

3. Lamella card according to claim item 1, wherein the four lamellae (21*a*, 22*a*) and the one fitted with the lever (23*a*) are designed and constructed all of a single piece.

4. Lamella card according to claim item 2 wherein the driving element (14) made as a drawing element is shaped in the form of an envelope (15).

5. Lamella card according to claim item 1, wherein the driving element (14) is made as a rotary wheel (38) or as a rotary wheel sector (38).

6. Lamella card according to claim item 5, wherein the rotary wheel (38) or rotary wheel sector (38) is connected with at least one lamella (21).

7. Lamella card according to claim item 5, wherein the rotary wheel (38) or the rotary wheel sector (38) has at the rim a raster (39) that protrudes at least partially.

8. Lamella card according to claim item 1, wherein each lamella (21, 22) has a straight edge (26), which edges are square to one another when the lamellae (21, 22) are assembled.

9. Lamella card according to claim item 1, wherein the first image carrier (9) has a square-shaped central section (11) and rectangular folding sections (12), the lengths of which correspond to the edge length of the central section (11) and their width to half the length of the central section (11).

10. Lamella card according to claim item 1, wherein the second image carrier (20) is round-shaped.

11. Lamella card according to claim item 1, wherein the wrapping (2) is made as a one-piece folding element.

12. Lamella card according to claim item 1, wherein the sighting window (7) is round-shaped with a diameter corresponding to a diameter of the second image carrier (20).

13. Lamella card according to claim item 1, wherein the first image carrier (9) is connected with the wrapping (2) by one of glue, pins, and insertion openings.

14. Lamella card according to claim item 1, wherein the sighting window (7) is closed.

15. Lamella card according to claim item 1, wherein the driving element (14) is covered.

16. Lamella card according to claim item 1, wherein the first image carrier (9) is a component part of the wrapping (2), which consists of a central section (11) with the sighting window (7) and the folding sections (12).

17. Lamella card comprising, in combination, a foldable wrapping (2) having at least one sighting window (7), a first image carrier (9) arranged inside the wrapping (2), which image carrier comprises a folding element (10) made of a central section (11) and four folding sections (12) alternately overlapping the central section (11) fitted with a guiding slot (13), and a second image carrier (20) comprising at least four lamellae (21, 22) inserted in one another and at least one of the lamella (22) is fitted with a lever (23), which is guided in the guiding slot (13) being connected to a driving element (14), and the lamellae (21, 22) are arranged in such a way between the central section (11) and the folding sections (12) that each lamella (21, 22) is brought under a first folding section (12) and over a second neighboring folding section (12) and can be driven by the motion of the driving element (14) from a covered position of the first folding section (12) over the second neighboring folding section (12).

18. Lamella card according to claim item 17, characterized by the driving element (14) being designed as a drawing element housed and guided inside the wrapping (2).

19. Lamella card according to claim item 17, characterized by the four lamellae (21*a*, 22*a*) and the one fitted with the lever (23*a*) being designed and constructed all of a single piece.

20. Lamella card according to claim item 18 characterized by the driving element (14) made as a drawing element being shaped in the form of an envelope (15) with an inserted card (19) as data carrier.

21. Lamella card according to claim item 17, characterized by each lamella (21, 22) having at least one straight edge (26), which edges are positioned adjacent to one another when the lamellae (21, 22) are assembled.

22. Lamella card according to claim item 17, characterized by the first image carrier (9) having a square-shaped central section (11) and rectangular folding sections (12), the lengths of which correspond to the edge length of the central section (11) and their width to half the length of the central section (11).

23. Lamella card according to claim item 17, characterized by the second image carrier (20) being round-shaped.

24. Lamella card according to claim item 17, characterized by the wrapping (2) being made as a one-piece folding element.

25. Lamella card according to claim item 17, characterized by the sighting window (7) being round-shaped with a diameter corresponding to a diameter of the second image carrier (20).

26. Lamella card according to claim item 17, characterized by the first image carrier (9) being connected with the wrapping (2) by one of glue, pins, and insertion openings.

27. Lamella card according to claim item 17, characterized by the sighting window (7) being closed by a removable cover (32).

28. Lamella card according to claim item 17, characterized by the driving element (14) being covered with a removable cover (34).

29. Lamella card according to claim items 27 or 28, characterized by the covers (32, 34) designed to be torn off along a perforation (33).

30. Lamella card according to claim items 27 or 28, characterized by the covers (32, 34) being connected to one another and made as a one-piece item.

31. Lamella card according to claim item 17, characterized by the first image carrier (9) being a component part of the wrapping (2), which consists of a central section (11) with the sighting window (7) and the folding sections (12).

* * * * *